United States Patent [19]

Larsen

[11] 4,010,587

[45] Mar. 8, 1977

[54] NAILABLE FLOORING CONSTRUCTION

[76] Inventor: Glen D. Larsen, 9805 Broadmoor Terrace, Upper Marlboro, Md. 20870

[22] Filed: Sept. 7, 1976

[21] Appl. No.: 720,678

[52] U.S. Cl. ..... 52/377; 105/422

[51] Int. Cl.[2] ..... E04B 5/10

[58] Field of Search ..... 105/422; 52/364–377

[56] References Cited

UNITED STATES PATENTS

| | | | |
|---|---|---|---|
| 2,955,687 | 10/1960 | Seim | 52/377 |
| 3,416,278 | 12/1968 | Swenck | 52/377 |
| 3,792,560 | 2/1974 | Naylor | 52/364 |

*Primary Examiner*—John E. Murtagh

*Attorney, Agent, or Firm*—Watson, Cole, Grindle & Watson

[57] ABSTRACT

Nailable flooring is constructed of identical floor units having roll-formed therein closed bottom nailing grooves of serpentine contour for the retention of nail fasteners held in place as they are deformed upon insertion into the grooves. The grooves are disposed between opposite side edges of the units and/or mating portions of such grooves are roll-formed along such side edges. The bottoms of the grooves are substantially triangular in cross-section thereby negating the crippling effect of each groove structure which thereby functions similarly to that of a beam web.

7 Claims, 5 Drawing Figures

NAILABLE FLOORING CONSTRUCTION

BACKGROUND OF THE INVENTION

This invention relates generally to a nailable floor construction, and more particularly to such a construction as having closed bottom serpentine nail-receiving grooves formed in such a manner therein as to render the flooring self-supporting and to prevent the entry into the grooves of any dirt, debris or heat from fire from below the flooring.

A wide variety of flooring constructions are known as having different types of nail-receiving grooves therein for the reception of nail fasteners held in place as they are deformed during insertion. The grooves are contoured to facilitate such deforming of the nail fasteners although, because of their particular construction, the groove structure is incapable of supporting the flooring without the provision of a central longitudinal support element which, quite obviously, only adds to the cost and complexity of such flooring constructions. On the other hand, nailable flooring units have been devised without the use of central support members, although the structural integrity and the reliability of such units remains doubtful. Both general types of flooring units thus far discussed, moreover, have nailing grooves open to the space therebelow. Hence, when such nailable constructions are used for example as the flooring for a railroad box car, the open bottom nailable grooves present a hazardous situation if fire were to break out beneath the flooring. The heat and even the flames themselves could easily penetrate the flooring through the open grooves and severely damage the contents supported thereon. Moreover, the box car contents lying directly on the nailable flooring are subject to contamination from the space therebelow as dirt, debris and other contaminants easily enter the interior of the box car through the open grooves.

Nailable surface construction units are nevertheless known as having nailable grooves with closed bottoms. However, the grooves are so designed as to merely crimp the nail fasteners upon insertion, rather than to more positively anchor the nail fasteners in place as by deforming.

SUMMARY OF THE INVENTION

It is an object of the present invention to provide a nailable floor structure of high reliability yet easy to manufacture as by roll-forming, easy to handle and highly economical.

In carrying out this general objective, the nailable flooring construction of the invention includes nail-receiving grooves having closed bottoms and of serpentine shape to effect deformation of the nail fasteners inserted therein. The groove structure likewise renders the flooring units self-supporting thereby eliminating the need for supplemental reinforcement requiring excess metal and extensive welding as in the past. The closed bottom grooves likewise prevent the entry of dirt and debris from therebelow through the grooves and into the compartment in which the flooring is mounted. Hazards due to fire and contaminants effecting the material supported on the flooring are likewise avoided by the closed bottom groove structure. And, individual units are capable of being removed from the flooring construction without disturbing the integrity thereof in accordance with two of the disclosed embodiments.

DETAILED DESCRIPTION OF THE INVENTION

Figure 1:
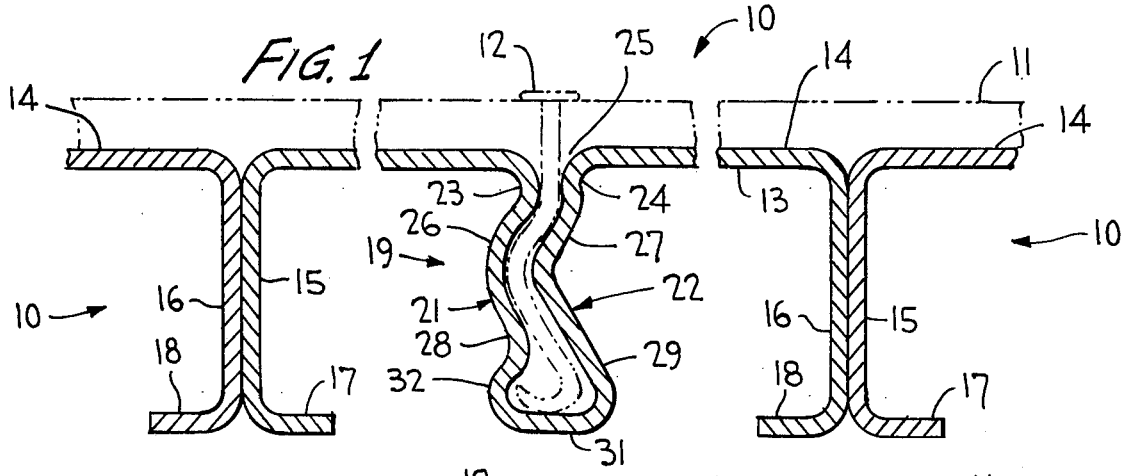
FIGS. 1 to 4 are cross-sectional views of four embodiments of the present floor construction invention.

Turning now to the drawings wherein like reference characters refer to like and corresponding parts throughout the several views, one embodiment of the nailable floor construction of the invention is shown in cross-section in FIG. 1 and comprises elongated units generally designated 10 in abutting engagement along opposite sides and which may be interconnected therealong as by welding. The central one of the units is shown in complete detail, it being understood that the adjoining units are of like construction with all of the units being supported on spaced parallel beams and which may form part of the frame work of a railroad freight car or other supporting structure similarly as in U.S. Pat. No. 2,852,112, which is specifically incorporated herein by reference. A package of freight may therefore be supported on the flooring and be prevented from shifting thereon as by means of a block or blocks 11 secured in place by a plurality of nail fasteners 12 inserted into the grooves.

Each floor construction unit 10 is formed of an elongated sheet 13 of strip or sheet metal which is roll-formed in accordance with a continuous cold forming process so as to progressively shape the sheet through sets of roller dies to the particular contour illustrated and to be described for each of the several embodiments.

Sheet 13 is of a predetermined gauge thickness formed as having an upper wall 14 lying in a common plane together with upper walls 14 of like adjacent units 10, opposed elongated side walls 15 and 16 being respectively joined along opposed longitudinal edges of the upper wall and lying substantially perpendicular thereto. Inwardly bent elongated flanges 17 and 18 are provided at the lower free edges of the side walls and extend longitudinally therewith. The flanges of each adjacent unit lie is substantially the same plane and rest on suitable spaced cross beams (not shown). Nailable groove structures, only one of which is shown at 19, are formed in sheet 13 and extend longitudinally thereof, it being noted that any number of these groove structures may be formed as required. The groove structure is roll-formed together with the side walls and flanges and is of a serpentine contour defined by a pair of spaced walls 21 and 22. Both walls are shaped as having first wall sections 23 and 24 respectively joined to the upper wall and being rounded relative thereto so as to define a throat section 25 longitudinally of the sheet for the reception of spaced nail fasteners 12. The wall sections of the groove further include second wall sections 26 and 27 respectively joined to sections 23 and 24 and sloping in a direction toward one of the side walls, such as side wall 15 illustrated in FIG. 1. Walls 21 and 22 of the groove structure still further include third wall sections 28 and 29 respectively joined to the second wall sections and sloping in a direction toward the other of the side walls as, for example, side wall 16.

The groove structure still further includes a base portion 31 joined along one edge to wall section 29 and having a leg 32 along its opposite edge which is joined to wall section 28. This leg 32 slopes in the same direction as sections 26 and 27. And it should be noted that the junctures between the various sections as aforedescribed are smooth and rounded as shown.

Thus, upon insertion of nail fasteners 12 into the serpentine groove defined between walls 21 and 22, each fastener is deformed as it follows the serpentine contour of the walls, as shown in phantom outline in FIG. 1. And depending on the length of the nails, the tips may be deformed as they strike against the inner surface of base section 31. Otherwise, the tips will not be so deformed. The holding power of the nail fasteners is thereby enhanced with such a groove construction, and the substantially triangular base formed at the bottom of the groove provides added structural strength for the groove and substantially negates the crippling effect of the serpentine groove which functions to support the unit thereby avoiding the need for supplemental reinforcement requiring excess metal and extensive welding as otherwise required. Base 31 lies in a common plane together with flanges 17 and 18 and thus rests on the cross beams while supporting the flooring unit. The closed bottom groove, moreover, effectively seals the groove against the loss of groove filler (not shown) which may be used to fill the groove in a manner known by those skilled in the art. The closed bottom of the nailing groove likewise prevents entry from below of dirt, debris and contaminants into the railroad car or other container in which the flooring construction is located, and likewise prevents such entry of fire from below which is especially hazardous to flammable and explosive materials supported on the flooring units. Also, it should be noted that the filler which is otherwise required for the grooves in prior art constructions may be entirely eliminated herein since the grooves with their closed bottoms effectively prevent any entry into the grooves from below as mentioned above.

Figure 2:
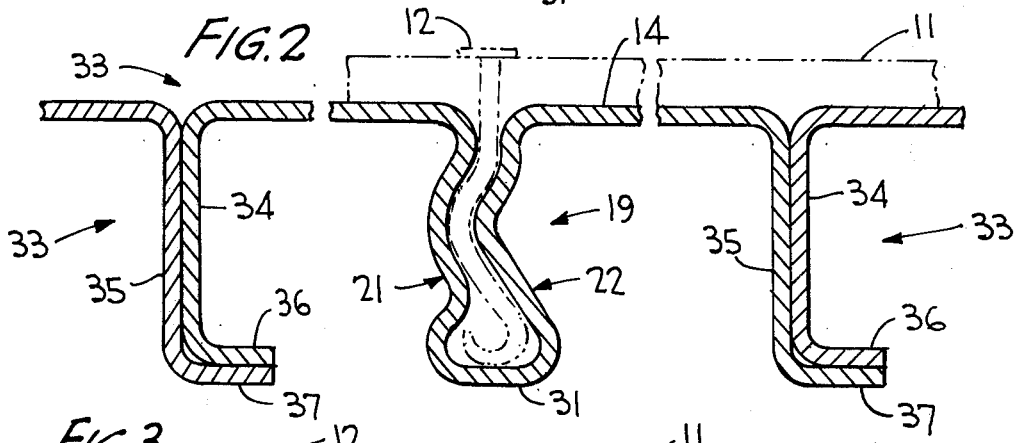

Flooring units generally designated 33 in FIG. 2 are similar to units 10 of FIG. 1 in that longitudinal groove structures 19 of identical construction as in FIG. 1 are roll-formed to be positioned between opposing side edges of top wall 14. However, elongated side walls 34 and 35 are respectively joined along the opposed edges of the upper wall and have flanges 36 and 37 facing in a common direction such that one flange such as 36 extends inwardly of its unit 33 while the other flange 37 extends outwardly thereof. And, flange 37 of each adjoining unit lies in a plane containing base section 31 while flanges 36 of each unit lie in a common plane spaced closer to upper wall 14 by a distance equal to the predetermined gauge thickness of sheet 13. Hence, flanges 36 of each unit overlie flanges 37 of adjacent units so that portions of each unit effectively nest within one another. Thus, in both the FIGS. 1 and 2 embodiments, welds or other connectors between units may be broken and a damaged unit effectively removed for replacement without disturbing the integrity of the entire flooring or the adjacent units.

Figure 3:
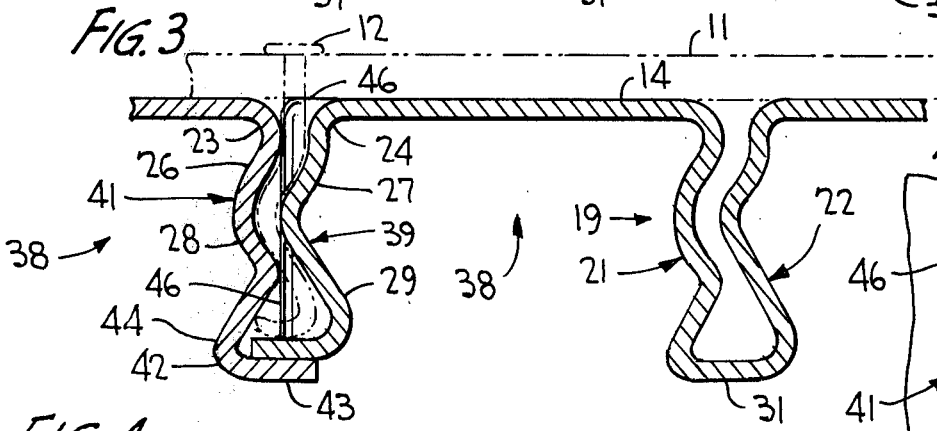

In FIG. 3 adjacent flooring construction units 38 are shown as having nail receiving groove structures 19 of identical construction as described with reference to FIG. 1 and roll-formed into the sheet so as to lie between opposed longitudinal edges of upper wall 14. However, in this construction, mating portions of groove structures 39 and 41 are provided in lieu of side walls 15, 16 or 34, 35 respectively shown in FIGS. 1 and 2. Groove portion 39 is identical to wall 22 of groove 19 in that it likewise includes first, second and third wall portions 24, 27 and 29, respectively. However, a flange 42 is joined to wall section 29 forming in effect part of the base section. Also, groove portion 41 is identical to wall 21 in that it includes first, second and third wall sections 23, 26 and 28, respectively, with an elongated flange 43 having an elongated leg 44 similar to leg 32 and joined to wall section 28. Flanges 42 and 43 of each unit 38 extend outwardly thereof with flanges 43 of adjacent units lying in a plane containing base sections 31. Flanges 42, on the other hand, of adjacent units overlap flanges 43 and lie in a single plane spaced closer to upper walls 14 by a distance equal to the predetermined gauge thickness of the sheet. A similar type of substantially triangular base is therefore defined for the grooves formed along the opposed side edges of units 38 by means of groove structure portions 39 and 41. These grooves so formed therefore perform in a manner identical to and serve the same purpose as grooves 19 aforedescribed.

Figure 4A:
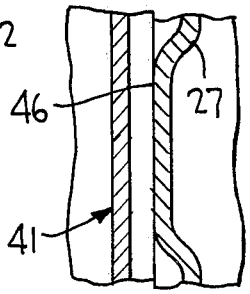
FIG. 4A is a fragmentary horizontal sectional view taken substantially along line 4A—4A of FIG. 4.
Figure 4:
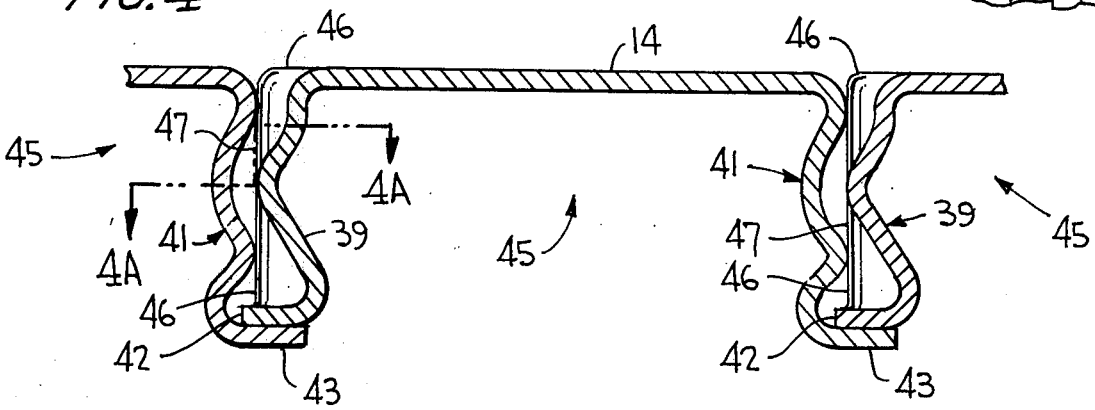

In the FIG. 4 embodiment, the flooring construction is formed by a plurality of adjacent units 45 similar to units 38 except that no grooves 19 are formed to lie between opposing longitudenal side edges thereof. Grooves are instead formed along such edges as defined by groove portions 39 and 41 which are identical to those described for FIG. 3 with flanges 43 of adjacent units lying in a common plane beneath flanges 42 of adjacent units which lie in a common plane spaced closer to upper walls 14 by a distance equal to the predetermined gauge thickness of the sheet.

Units 38 of FIG. 3 and units 45 of FIG. 4 may be conveniently spaced apart without the use of tools or individual spacers imply by the provision of spacing means such as spacing bridges 46 shown in these Figures as well as in Figure 4A formed on groove portions 39 and presenting flat external surfaces 47 lying perpendicular to upper walls 14 and extending between the upper walls and flanges 42. These bridges are spaced longitudinally along portions 39 and lie in vertical planes containing the extremities of the junctures between second and third wall sections 27 and 29 as illustrated in the drawings. Hence, groove portions 41 of the adjacent units may be so positioned as to abut against these external surfaces 47 to thereby conveniently space portions 39 and 41 of the grooves apart a predetermined distance. Such spacing bridges are disclosed in U.S. Pat. No. 2,852,112 and the details thereof are specifically incorporated herein by reference.

From the foregoing it can be seen that nailing grooves may be provided both between opposing longitudinal edges of the upper walls of the flooring construction units and/or along such edges. The particular nailing groove structure is such as to eliminate the need for supplemental reinforcement. Hence, the jigging, welding and resulting heat distortion otherwise required for installation of such reinforcement is avoided thereby minimizing construction costs and effecting floor construction units of lighter weight. The nail receiving grooves are preferably roll-formed into such shape as to enhance the holding power of the nail fasteners by deforming them while permitting a combination of a larger range of nail sizes in diameter as well as in length. The nailing grooves with their closed bottoms likewise avoid the entry of any dirt, debris or contaminants within the railroad car or container in which the flooring units are provided while at the same time avoiding the entry of sparks of flames into such space from the area below the grooves. And the triangular base portion of the grooves provide added structural strength to thereby negate the crippling effect of the serpentine groove upon application of forces exerted downwardly on upper walls 14. And, individual flooring units of the FIGS. 1 and 2 embodiments may be easily removed for replacement without destroying adjacent units.

Obviously, many other modifications and variations of the present invention are made possible in the light of the above teachings. It is therefore to be understood that within the scope of the appended claims the invention may be practiced otherwise than as specifically disclosed.

What is claimed is:

1. A nailable floor construction unit, comprising: an elongated sheet having an upper wall with opposed longitudinal edges; elongated side walls respectively joined along said edges and extending in a common direction perpendicular to said upper wall; elongated flanges parallel to said upper wall and respectively joined to said side walls; said upper wall having roll-formed therein at least one longitudinal serpentine nailing groove extending in said common direction and defined by a pair of spaced walls, said groove walls including first wall sections respectively joined to said upper wall and being rounded relative thereto, said groove walls further including second wall sections respectively joined to said first wall sections and sloping in a direction toward one of said side walls, said groove walls still further including third wall sections respectively joined to said second wall sections and sloping in a direction toward the other of said side walls, and a bottom wall section having a leg forming together with said third wall sections a substantially triangular cross-sectional base for said groove, and edge of said bottom wall section joining one of said third wall sections and said leg joining the other of said third wall sections and sloping in a direction parallel to said second wall sections, and said bottom wall section lying in a plane common to at least one of said flanges; whereby flooring may be secured to said unit with the use of nail fasteners held in place as they are deformed by said wall sections during insertion into said groove and whereby said triangular base of said groove increases the structural strength of said groove and said bottom wall section closes said groove against the entry thereinto of any dirt, debris or heat from fire from outwardly of said bottom wall section.

2. The unit according to claim 1, wherein said side walls are substantially flat between said upper wall and said flanges thereon to facilitate a flat abutment against adjacent units having flat side walls, and said flanges extending inwardly of said sheet and lying in said plane common to said bottom wall section.

3. The unit according to claim 1, wherein said side walls are substantially flat between said upper wall and said flanges thereon to facilitate a flat abutment against adjacent units having flat side walls, said sheet having a predetermined thickness and said one flange extending outwardly of said sheet, the other of spaced flanges extending inwardly of said sheet and lying in a plane spaced inwardly of said common plane toward said upper wall a distance equal to said predetermined thickness, whereby said flanges permit a nesting together of like flanges on the adjacent units.

4. The unit according to claim 1, wherein one of said side walls includes first, second and third wall sections respectively parallel to said first, second and third wall sections of one of said spaced walls, and the other of said side walls includes first, second and third wall sections respectively parallel to said first, second and third wall sections of the other said spaced walls, said flange of a first of said side walls joining said third wall section thereof, and said flange of a second of said side walls having leg joining said third wall section thereof and sloping in a direction parallel to said second wall section, said sheet having a predetermined thickness and said flanges extending outwardly of said sheet, said flange on said second side wall lying in a plane common to said bottom wall and said flange on said first side wall lying in a plane spaced inwardly of said common plane toward said upper wall a distance equal to said predetermined distance, whereby said side walls together form serpentine nailing grooves when said respective flanges thereof overlap with flanges of like adjacent units.

5. The unit according to claim 4, wherein a plurality of longitudinally spaced spacer means are provided on said one side wall and have outer surfaces lying in a plan perpendicular to said upper wall and extending outwardly thereof for spacing an adjacent unit which may abut thereagainst.

6. A nailable floor construction unit, comprising: an elongated sheet having an upper wall with opposed longitudinal edges; elongated side walls respectively joined along said edges and extending in a common direction perpendicular to said upper wall; elongated flanges parallel to said upper wall and respectively joined to said side walls, said flanges extending outwardly of said sheet; said side walls including first wall sections respectively joined to said upper wall and being rounded relative thereto, said side walls further including second wall sections respectively joined to said first wall sections and sloping in one direction relative to said upper wall, said side walls still further including third wall sections respectively joined to said second wall sections and sloping in a direction opposite said one direction relative to said upper wall; said sheet having a predetermined thickness; said flanges on one of said side walls joining said third section thereof, and said flange on the other of said side walls having a leg joining said third section thereof and sloping parallel to said one direction; said flanges lying in planes parallel to said upper wall and spaced apart a distance equal to said predetermined thickness; whereby said side walls together form serpentine nailing grooves when said respective flanges thereof overlap with flanges of like adjacent units.

7. The unit according to claim 6, wherein a plurality of longitudinally spaced spacer means are provided on said one side wall and have outer surfaces lying in a plane perpendicular to said upper wall and extending outwardly thereof for spacing an adjacent unit which may abut thereagainst.

* * * * *